United States Patent [19]

Hotta et al.

[11] 4,216,456

[45] Aug. 5, 1980

[54] CURRENT LIMITING APPARATUS

[75] Inventors: Shigenori Hotta; Sadaaki Baba; Masaru Takahashi, all of Nagoya, Japan

[73] Assignee: Mitsubishi Denki Kabushiki Kaisha, Tokyo, Japan

[21] Appl. No.: 952,395

[22] Filed: Oct. 18, 1978

[30] Foreign Application Priority Data

Jul. 18, 1978 [JP] Japan ..... 53-98500[U]

[51] Int. Cl.[2] ..... H01H 37/36; H01H 61/00; H01H 87/00

[52] U.S. Cl. ..... 337/114; 337/121; 337/202; 337/327

[58] Field of Search ..... 337/114, 121, 323, 327, 337/328, 117, 118, 202, 204

[56] References Cited

U.S. PATENT DOCUMENTS 3,699,489 10/1972 Imajyo ..... 337/121 X
3,991,396 11/1976 Barkan ..... 337/114

FOREIGN PATENT DOCUMENTS 2427472 12/1974 Fed. Rep. of Germany ..... 337/118

OTHER PUBLICATIONS

Japanese Unexamined Utility Model Publication No. 88934, "Fault Current Limiting Apparatus", 10-26-73, Application No. 13015/72 to M. Takahashi.

*Primary Examiner*—George Harris
*Attorney, Agent, or Firm*—Oblon, Fisher, Spivak, McClelland & Maier

[57] ABSTRACT

A current limiting apparatus comprises a current limiter and cooling fins formed on each current terminal of the current limiter, and additional cooling fins fitted on a cylindrical tube of the current limiter near a heat generating source.

27 Claims, 10 Drawing Figures

CURRENT LIMITING APPARATUS

BACKGROUND OF THE INVENTION

The present invention relates to a current limiting apparatus comprising a current limiter which changes to be high resistant state to limit or to break a current when an overcurrent such as short-circuit current is passed and which returns to the normal resistant condition by self-recovery when the overcurrent is reduced to the normal current. It has especially an advantage of effective heat radiation.

Heretofore, the current limiting apparatus shown in FIGS. 1 and 2 has been used.

In FIGS. 1 and 2, the reference numeral (1) designates a current limiter; (11) and (12) designate current terminals which are independently formed at both of ends of the current limiter (1) and which have each screw thread; (2) designates cooling fins made of aluminum which has each female screw hole connected to each current terminal (11), (12) and the female screw hole is formed in the direction of grooves for the fins and a current lead-in terminal (21) is projected from the cooling fins (2). The current limiting apparatus is assembled by screwing each bolt part of the current limiter (1) into each female screw hole of the cooling fins (2) and fastening them with each clamp nut (3).

FIG. 3 shows the current limiter (1) in detail.

In FIG. 3, the reference numeral (13) designates an insulator made of magnetic shield material such as BeO and a communicating hole is formed at the center of the insulator; (11) and (12) designate current terminals which are independently disposed through each insulator (13) at each end of the current limiter and have each space at each inner part. A closed housing is formed by the current terminals (11), (12) and the insulator (13). The reference numeral (14) designates a current limiting substance which is filled in the housing and which electrically connects between the current terminals (11), (12). For example, sodium metal is used as the current limiting substance. The reference numeral (15) designates a piston which is slidably fitted in the housing so as to perform the inner pressure buffering function; (16) designates a charged gas which is compressed by sliding the piston (15) to perform the spring function; (17) designates a cylindrical tube made of non-magnetic metal which cover the current limiter (1).

The current limiting operation of the current limiting apparatus will be illustrated.

When overcurrent such as short-circuit is passed through the current limiter (1), the current limiting substance (sodium metal) (14) is suddenly converted to be plasma having high resistance at high temperature under high pressure by self-Joule heating whereby the resistance between the current terminals (11), (12) are suddenly increased to control the current.

Rates of increases of resistance of the sodium metal depending upon rising of temperature are shown in the following table.

Table

| Rate of increase of resistance of sodium metal (at 20° C. specific resistance 4.6μΩcm) | | |
|---|---|---|
| Temperature | State | Rate of increase of resistance |
| 40° C. (normal) | solid | 1.0 |
| 98° C. | liquid | 2.2 |
| 883° C. | gas | 100 |

Table-continued

| Rate of increase of resistance of sodium metal (at 20° C. specific resistance 4.6μΩcm) | | |
|---|---|---|
| Temperature | State | Rate of increase of resistance |
| 5000° K. | plasma | 4800 |

When the overcurrent is passed, the gas at high temperature under high pressure is filled in the housing of the current limiter (1). Thus, the pressure is buffered by the action of the piston (15) as a pressure buffering element.

When the overcurrent is broken, the sodium metal is cooled and is rapidly recovered to be the normal condition by the action of the piston (15) pressed by the charged gas (16) whereby the continuous current feeding is attained.

When the current limiting apparatus is used under passing the rated current, the Joule heat generated in the current limiter (1) is transmitted through the bolts parts of the current terminals (11), (12) and is radiated from the cooling fins (2) of the current terminals.

In order to increase the rated current of the current limiting apparatus, (a) an inner resistance of the current limiter is decreased to reduce the generation of the Joule heat or (b) the Joule heat generated in the current limiter is effectively radiated out of the system.

Accordingly, in the former case (a) the inner resistance is decreased by increasing the amount of the current limiting substance filled in the current limiter. However, the size of the current limiter is increased and the cost is increased, disadvantageously. In the latter case (b), the size of the cooling fins is increased to radiate effectively the heat. However, the size of the apparatus is increased disadvantageously. Both of the considerations are not suitable to overcome the problem.

SUMMARY OF THE INVENTION

It is an object of the present invention to provide a current limiting apparatus which comprises cooling fins at both current terminals together with additional cooling fins on the current limiter generating Joule heat to improve heat radiation efficiency whereby a rated current is increased without increasing a size of the apparatus.

The current limiting apparatus of the present invention comprises additional cooling fins on an outer wall of a current limiter around a housing filling a current limiting substance whose phase is converted by heat generation caused by overcurrent to give high resistance and to impart current limiting function and current terminals connected to each end of the current limiter and cooling fins disposed on each current terminal.

DETAILED DESCRIPTION OF THE PREFERRED EMBODIMENTS

Figure 1:
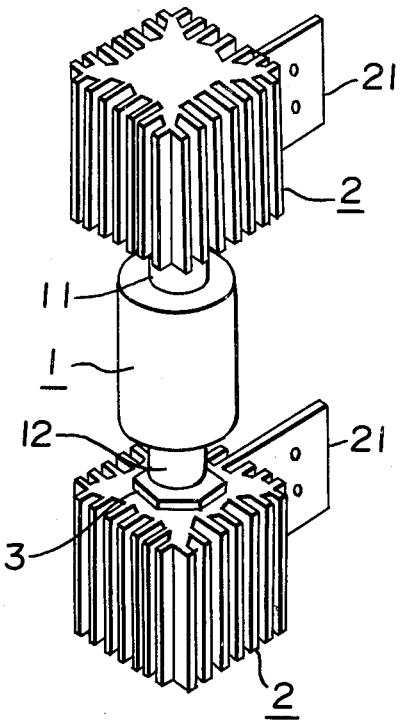
FIG. 1 PRIOR ART
FIG. 1 is a schematic view of a conventional current limiting apparatus.
Figure 2:
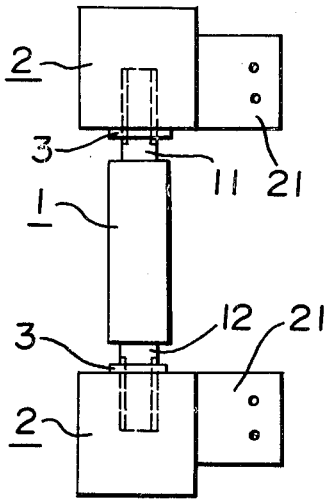
FIG. 2 PRIOR ART
FIG. 2 is a front view of the conventional current limiting apparatus.
Figure 3:
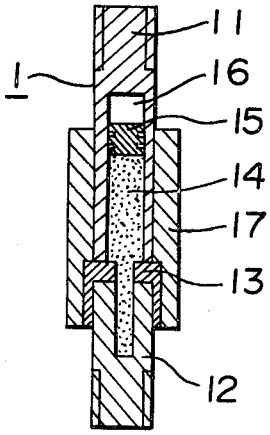
FIG. 3 PRIOR ART
FIG. 3 is a sectional view of a conventional current limiter.
Figure 4:
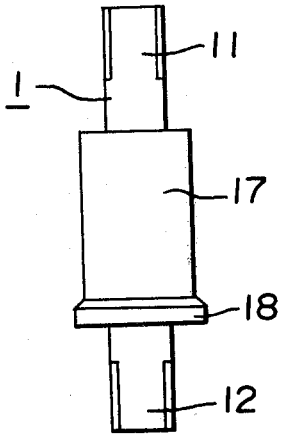
FIG. 4 is a front view of one embodiment of a current limiter of the present invention.
Figure 6:
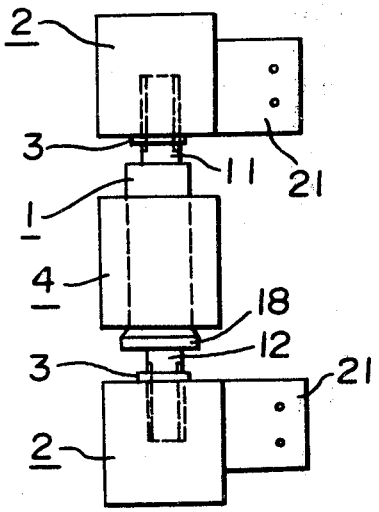
FIG. 6 is a front view of one embodiment of a current limiting apparatus on which additional cooling fins are fitted.
Figure 5:
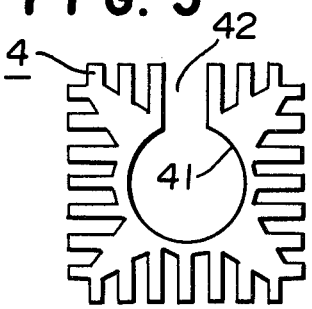
FIG. 5 is a plan view of one embodiment of additional cooling fins of the present invention.

Referring to FIGS. 4 to 6, one embodiment of the present invention will be illustrated.

FIG. 4 shows the current limiter which comprises a retaining ring (18) formed in one piece with a cylindrical tube (17) at the lower end of the cylindrical tube (17) of the current limiter (1) having the same structure with the conventional one.

FIG. 5 shows a plan view of the additional cooling fins made of aluminum etc., fitted on the cylindrical tube (17) of the current limiter (1).

The outer sizes of the additional cooling fins (4) are substantially the same with those of the cooling fins (2) fitted on the current terminals (11), (12) of the current limiter (1). A hole (41) which has an inner diameter being slightly smaller than or substantially similar to the diameter of the cylindrical tube (17), is formed at the center of the additional cooling fins in the direction of the cooling fins and an opening (42) formed in the axial direction of the hole (41).

FIG. 6 shows the structure of the current limiter (1) fitting the additional cooling fins (4). A grease containing metallic powder having polygonal shape is coated on the hole (41) of the additional cooling fins (4) and the additional cooling fins (4) are put on the cylindrical tube (17) of the current limiter (1) to contact with the retaining ring (18) whereby the additional cooling fins (4) are fixed on the cylindrical tube (17) of the current limiter (1) under resilience of the additional cooling fins (4) and the cylindrical tube (17) is thermally connected to the additional cooling fins (4) with the metallic powder included in the grease to improve the thermal conductivity.

A magnetic insulating material such as beryllia having high thermal conductivity as that of aluminum is used for the insulator (13) of the current limiter (1). A metallic substance such as aluminum is used for the cylindrical tube (17) whereby Joule heat generated in the current limiter (1) is effectively transmitted to the additional cooling fins (4) and the rated current of the current limiting apparatus can be increased for about 30% even though the current limiter (1) whose capacity is the same with the conventional one, is used.

The directions of the grooves of the additional fins (4) are arranged to the axial direction so as to improve the heat radiation by the natural convection system and the air flow in the grooves is improved.

Figure 7:
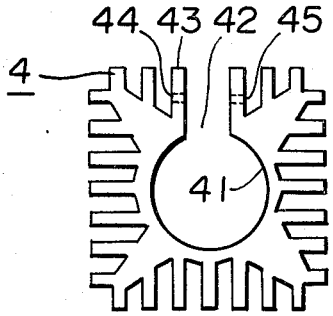
FIGS. 7 and 8 are independently plan views of the other embodiment of additional cooling fins.
Figure 8:
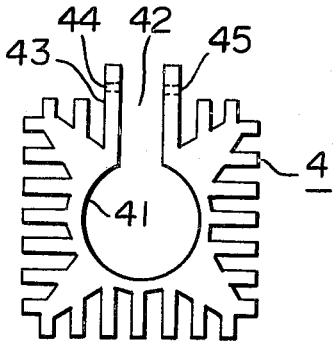
Figure 9:
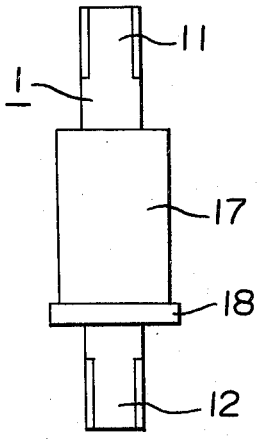
FIGS. 9 and 10 are independently front views of the other embodiments of the present invention.
Figure 10:
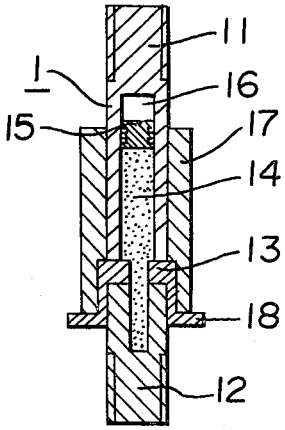

FIGS. 7 and 8 show the other embodiments of the additional cooling fins (4) and FIGS. 9 and 10 show the other embodiments of the retaining ring (18) of the current limiter (1).

In the structure of the additional cooling fins (4) of FIG. 7, a female screw hole (44) is formed on one of pair fins (43) and a through hole (45) for screw is formed on the other of the pair fins (43). After fitting the additional cooling fins (4) on the current limiter (1), the pair fins (43) are fastened by a screw so as to fix firmly the additional cooling fins on the current limiter.

In the structure of the additional cooling fins (4) of FIG. 8, two fins facing the opening (42) have longer length so as to be easily fastening them.

In the structure of the additional cooling fins (4) having the screw hole (44) as shown in FIGS. 7 and 8, the cooling fins are fixed by screwing after fitting the additional cooling fins on the current limiter (1) whereby the diameter of the hole (41) of the additional cooling fins (4) can be slightly larger than the diameter of the cylindrical tube (17) of the current limiter (1) and the current limiter (1) can be easily fitted in the hole (41) of the additional cooling fins (4) and the current limiter (1) can be closely contacted with the additional cooling fins (4) even though the grease containing metallic powder is not coated on the fitting surfaces.

FIG. 9 shows the other embodiment of the current limiter (1) wherein a separate retaining ring (18) is fixed on the cylindrical tube (17).

FIG. 10 shows the other embodiment of the current limiter (1) wherein a retaining ring (18) is formed by expanding the diameter of the lower end of the insulator (13) larger than the diameter of the cylindrical tube (17). Both of them can be easily fabricated. The retaining member (18) is not limited to a ring shape but it should have one or more projected part from the cylindrical tube (17).

The retaining member (18) defines the position of the additional cooling fins (4) fitted on the current limiter (1) to prevent shifting of the additional cooling fins (4) from the predetermined position on the current limiter (1) even though the clamp screw is loosed during the use of the current limiting apparatus and to prevent the short-circuit between the current terminal (11) and the current terminal (12) caused by shifting the additional cooling fins (4).

In said embodiments, the additional cooling fins (4) are fitted on the outer surface of the current limiter (1). Thus, the similar effect can be attained by fitting the cooling fins (4) on the other heat generating element such as a power fuse.

In accordance with the present invention, the cooling fins are formed on the current terminals of the current limiter as the conventional current limiting apparatus and the additional cooling fins are further formed on the current limiter near the heat generating source whereby Joule heat generated from the current limiter is rapidly and effectively radiated out of the system and the rated current of the apparatus can be increased. Moreover, an outer size of the additional cooling fins can be substantially the same with that of the cooling fins formed on the current terminal whereby the size of the apparatus is not increased even though higher rated current is given.

In the structure of the current limiting apparatus of the present invention, only additional cooling fins can be fitted on the conventional current limiting apparatus in the mass production. The current limiting apparatus having higher rated current can be assembled with the additional parts and the standerized parts for the conventional current limiting apparatus whereby the cost of the current limiting apparatus is relatively low.

What is claimed is:

1. In a current limiting apparatus comprising a current limiter housing filled with a current limiting substance whose phase is converted by heat generation caused by overcurrent to produce a high resistance and thus to impart a current limiting function, said apparatus further comprising current terminals connected to each end of said current limiter housing with cooling fins disposed on each current terminal, an improvement which comprises a cooling fin assembly surrounding an outer wall of said current limiter housing filled with said current limiting substance.

2. A current limiting apparatus according to claim 1 wherein said cooling fin assembly defines a fitting hole having a suitable diameter for fitting said cooling fin assembly over said outer wall of said current limiter housing and wherein said assembly further defines an opening formed in a part of the side wall of said cooling fin assembly extending through said fitting hole.

3. A current limiting apparatus according to claim 2 wherein the diameter of said fitting hole in said cooling fin assembly is slightly smaller than the diameter of the outer wall of said current limiter housing and wherein said cooling fin assembly is fitted on said current limiter housing by the resilience of said cooling fin assembly.

4. A current limiting apparatus according to claim 2 wherein said cooling fin assembly includes a clamp formed from a pair of fins facing the opening in said cooling fin assembly.

5. A current limiting apparatus according to claim 1, 2, 3 or 4 wherein the external size of said cooling fin assembly fitted on the outer wall of said current limiter housing filled with said current limiting substance is substantially the same as the external size of said cooling fins disposed on said current terminals.

6. A current limiting apparatus according to claim 1, 2, 3 or 4 wherein at least a portion of a lower peripheral part of the outer wall of said current limiter housing is larger than the upper peripheral part.

7. A current limiting apparatus according to claim 1, 2, 3 or 4 wherein a grease containing metallic powder is coated on one of the outer wall of said current limiter housing and the inner surface of said fitting hole in said cooling fin assembly.

8. A current limiting apparatus according to claim 1, 2, 3 or 4 wherein said current limiter apparatus further comprises: a pair of conductive containers which are disposed within said housing and which are used as said current terminals, said pair of containers defining an inner space therebetween; an insulator which is located between said pair of containers, said insulator including a hole therein such that said containers communicate with each other through said hole in said insulator; and a current limiting substance filling said inner space formed by said containers and said insulator.

9. A current limiting apparatus according to claim 8 wherein a part of said insulator projects to form a retainer ring adjacent to said housing, said retainer ring having a larger diameter than said housing.

10. A current limiting apparatus according to claim 5 wherein at least a portion of a lower peripheral part of the outer wall of said current limiter housing is larger than the upper peripheral part.

11. A current limiting apparatus according to claim 5 wherein a grease containing metallic powder is coated on one of the outer wall of said current limiter housing and the inner surface of said fitting hole in said cooling fin assembly.

12. A current limiting apparatus according to claim 6 wherein a grease containing metallic powder is coated on one of the outer wall of said current limiter housing and the inner surface of said fitting hole in said cooling fin assembly.

13. A current limiting apparatus according to claim 10 wherein a grease containing metallic powder is coated on one of the outer wall of said current limiter housing and the inner surface of said fitting hole in said cooling fin assembly.

14. A current limiting apparatus according to claim 5 wherein said current limiter apparatus further comprises: a pair of conductive containers which are disposed within said housing and which are used as said current terminals, said pair of containers defining an inner space therebetween; an insulator which is located between said pair of containers, said insulator including a hole therein such that said containers communicate with each other through said hole in said insulator; and a current limiting substance filling said inner space formed by said containers and said insulator.

15. A current limiting apparatus according to claim 6 wherein said current limiter apparatus further comprises: a pair of conductive containers which are disposed within said housing and which are used as said current terminals, said pair of containers defining an inner space therebetween; an insulator which is located between said pair of containers, said insulator including a hole therein such that said containers communicate with each other through said hole in said insulator; and a current limiting substance filling said inner space formed by said containers and said insulator.

16. A current limiting apparatus according to claim 7 wherein said current limiter apparatus further comprises: a pair of conductive containers which are disposed within said housing and which are used as said current terminals, said pair of containers defining an inner space therebetween; an insulator which is located between said pair of containers, said insulator including a hole therein such that said containers communicate with each other through said hole in said insulator; and a current limiting substance filling said inner space formed by said containers and said insulator.

17. A current limiting apparatus according to claim 10 wherein said current limiter apparatus further comprises: a pair of conductive containers which are disposed within said housing and which are used as said current terminals, said pair of containers defining an inner space therebetween; an insulator which is located between said pair of containers, said insulator including a hole therein such that said containers communicate with each other through said hole in said insulator; and a current limiting substance filling said inner space formed by said containers and said insulator.

18. A current limiting apparatus according to claim 11 wherein said current limiter apparatus further comprises: a pair of conductive containers which are disposed within said housing and which are used as said current terminals, said pair of containers defining an inner space therebetween; an insulator which is located between said pair of containers, said insulator including a hole therein such that said containers communicate with each other through said hole in said insulator; and a current limiting substance filling said inner space formed by said containers and said insulator.

19. A current limiting apparatus according to claim 12 wherein said current limiter apparatus further comprises: a pair of conductive containers which are disposed within said housing and which are used as said current terminals, said pair of containers defining an inner space therebetween; an insulator which is located between said pair of containers, said insulator including a hole therein such that said containers communicate with each other through said hole in said insulator; and a current limiting substance filling said inner space formed by said containers and said insulator.

20. A current limiting apparatus according to claim 13 wherein said current limiter apparatus further comprises: a pair of conductive containers which are disposed within said housing and which are used as said current terminals, said pair of containers defining an inner space therebetween; an insulator which is located between said pair of containers, said insulator including a hole therein such that said containers communicate with each other through said hole in said insulator; and a current limiting substance filling said inner space formed by said containers and said insulator.

21. A current limiting apparatus according to claim 14 wherein a part of said insulator projects to form a retainer ring adjacent to said housing, said retainer ring having a larger diameter than said housing.

22. A current limiting apparatus according to claim 15 wherein a part of said insulator projects to form a retainer ring adjacent to said housing, said retainer ring having a larger diameter than said housing.

23. A current limiting apparatus according to claim 16 wherein a part of said insulator projects to form a retainer ring adjacent to said housing, said retainer ring having a larger diameter than said housing.

24. A current limiting apparatus according to claim 17 wherein a part of said insulator projects to form a retainer ring adjacent to said housing, said retainer ring having a larger diameter than said housing.

25. A current limiting apparatus according to claim 18 wherein a part of said insulator projects to form a retainer ring adjacent to said housing, said retainer ring having a larger diameter than said housing.

26. A current limiting apparatus according to claim 19 wherein a part of said insulator projects to form a retainer ring adjacent to said housing, said retainer ring having a larger diameter than said housing.

27. A current limiting apparatus according to claim 20 wherein a part of said insulator projects to form a retainer ring adjacent to said housing, said retainer ring having a larger diameter than said housing.

* * * * *